US006019714A

United States Patent [19]

Stäb

[11] Patent Number: 6,019,714

[45] Date of Patent: Feb. 1, 2000

[54] FOLDING APPARATUS WITH SIGNATURE DIVIDER

[75] Inventor: Rudolf Stäb, Frankenthal, Germany

[73] Assignee: Koenig & Bauer Aktiengesellschaft, Wurzburg, Germany

[21] Appl. No.: 09/091,423

[22] PCT Filed: Dec. 12, 1996

[86] PCT No.: PCT/DE96/02390

§ 371 Date: Jun. 24, 1998

§ 102(e) Date: Jun. 24, 1998

[87] PCT Pub. No.: WO97/24284

PCT Pub. Date: Jul. 10, 1997

[30] Foreign Application Priority Data

Dec. 27, 1995 [DE] Germany ..... 195 48 815

[51] Int. Cl.[7] ..... B31F 1/08; B31B 1/14

[52] U.S. Cl. ..... 493/429; 493/432; 493/357; 493/23

[58] Field of Search ..... 493/356, 357, 493/428, 429, 432, 8, 23

[56] References Cited

U.S. PATENT DOCUMENTS

| | | | |
|---|---|---|---|
| 4,373,713 | 2/1983 | Loebach . | |
| 4,461,467 | 7/1984 | Herb . | |
| 4,721,294 | 1/1988 | Petersen . | |
| 5,520,378 | 5/1996 | Kepert et al. | 493/429 |
| 5,573,231 | 11/1996 | Stab | 270/43 |
| 5,653,428 | 8/1997 | Dufour et al. | 493/14 |

FOREIGN PATENT DOCUMENTS

| | | |
|---|---|---|
| 0055405 | 12/1981 | European Pat. Off. . |
| 0 054963 | 5/1985 | European Pat. Off. . |
| 0269489 | 4/1988 | European Pat. Off. . |
| 0315932 | 5/1989 | European Pat. Off. . |
| 0257390 | 1/1990 | European Pat. Off. . |
| 2512368 | 9/1976 | Germany . |
| 9320408 | 8/1994 | Germany . |
| 4313938 | 11/1994 | Germany . |

*Primary Examiner*—John Sipos
*Assistant Examiner*—Steven Jensen
*Attorney, Agent, or Firm*—Jones, Tullar & Cooper, P.C.

[57] ABSTRACT

A folding apparatus is used to cross-fold printed matter, particularly of variable section lengths. Damage to the printed products is avoided, even at high production speeds. This is accomplished by providing a signature divider after a transverse cutting device, and before two parallel cross-folding devices. The signatures divider alternatingly direct the signatures into two product flow paths. Each product flow path acts as a deceleration line so that the signatures are delivered to the cross-folding devices at half of their original speed.

11 Claims, 4 Drawing Sheets

FOLDING APPARATUS WITH SIGNATURE DIVIDER

FIELD OF THE INVENTION

The present invention relates to a folding apparatus of a rotary printing press for cross-folding printed products, in particular printed products of variable section lengths.

DESCRIPTION OF THE PRIOR ART

A device with a signature divider for separating the signatures into two signature paths is known from EP 0 054 963 B1.

EP 0 055 405 A1 describes a belt section for transporting and slowing-down folded products between two successive stations of a folding apparatus. In this prior art device, two successive sections of belt systems are provided, which are driven at speeds which are stepped in respect to each other.

SUMMARY OF THE INVENTION

It is the object of the present invention to create a folding apparatus.

In accordance with the invention this object is attained by providing a folding apparatus for rotary printing presses with at least one cross-folding device for folding individual signatures. These signatures are divided into two signature paths by a signature divider. Each of these signature paths is provided as a signature deceleration section whose speed can be controllable.

The advantages which can be achieved by the present invention reside in particular in that at the high production speeds of a folding apparatus with variable section lengths, damage to the signatures on their way from the cutting devices to the cross-folding devices is prevented. The acceleration of signatures of shorter section length in particular is not required because of dividing the signatures into two product flow paths. It is therefore not necessary to accelerate shorter signatures to the gripper distance of a collection cylinder, such as has been necessary in connection with folding apparatus known in the prior art. The gap created by the division of the product flow is used for slowing down the partial flows in order to perform the cross-folding process at this reduced speed. Accordingly, cross-folding of the signatures in the product flow paths takes place at a lesser speed in comparison with the inlet speed, so that the effects of the whip effect are reduced or lessened and no longer have a damaging effect on the folded product.

BRIEF DESCRIPTION OF THE DRAWINGS

A preferred embodiment of the present invention is represented in the drawings and will be described in more detail in what follows.

Shown are in.

DESCRIPTION OF THE PREFERRED EMBODIMENT

Figure 2:
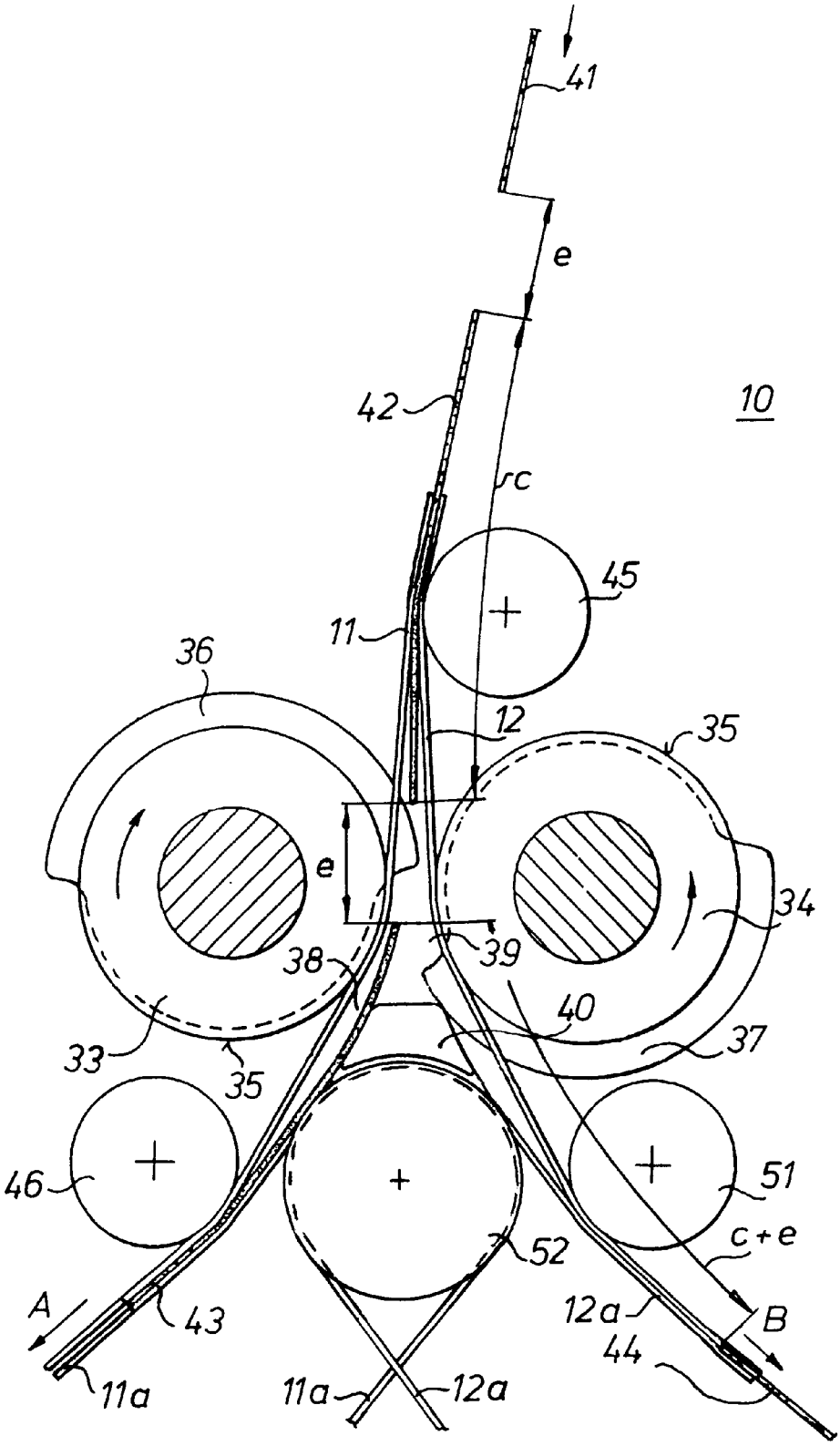
FIG. 2, a representation of enlarged details of a signature divider in accordance with FIG. 1 with signatures.

A folding apparatus 1 of a rotary printing press has a draw-in roller group 2 for drawing in a printed and possibly longitudinally folded product train 3. A transverse cutting device 7, which consists of two pairs of cutting cylinders 4, 6 placed one after the other, is provided underneath or after, in the direction of product travel the draw-in roller group 2. The first cutting cylinder pair 4 makes a transverse perforating cut in the product train 3. The remaining webs are cut through by the second cutting cylinder pair 6, so that a complete cut is created. A signature divider 10 is disposed underneath the transverse cutting device 7, and alternatingly assigns all signatures 41, 42, 43, 44 cut from the product train 3 to one of two product flow paths A, B as seen in FIG. 2. A drivable belt system 11, 12 surrounds each cutting cylinder of the cutting cylinder pair 6, as well as each changing or divider member 33, 34 of the signature divider 10. The drivable belt system 11, 12 is supplemented downstream in the product flow by an additional or secondary drivable belt system 11*a*, 12*a* running at the same speed. This secondary drivable belt system 11*a*, 12*a* respectively adjoins a belt system 17, or respectively 22, of the product flow path A, or respectively B, or respectively overlaps it. Each product flow path A, B respectively consists of a deceleration section 13, 14. Each deceleration section 13, 14 is preferably designed in two stages and comprises a first stage deceleration belt system 16, 17 and a second stage deceleration belt system 18, 19 for the production flow path A, and for the production flow path B a first stage deceleration belt system 21, 22 and a second stage deceleration belt system 23, 24. All deceleration belt systems 16 to 19 and 21 to 24 can be separately driven. The second stage deceleration belt systems 18, 19, or respectively 23, 24 of the deceleration section 13, 14 are driven at the same circumferential speed as the cylinders 28, 29 following them. A cross-folding device 26, 27, which respectively consists of a gripper and folding blade cylinder 28, 29 of, for example, seven elements, as well as a folding jaw cylinder 31, 32 of, for example seven elements, respectively cooperating with the folding blade cylinder 28, 29, follows each production flow path A, B.

The signature divider 10 as seen in FIG. 2 consists of a pair, i.e. two corotating cylinder-shaped changing of divider members 33, 34, at each of whose periphery 35 a raised curved section 36, 37 is respectively arranged. A divider tongue 40, which is fixed in place, respectively cooperates alternatingly with one of the two curved sections 36, 37 of the cylinder-shaped rotatable divider members 33, 34, so that the inlets 38, 39 of the production flow paths A, B are alternatingly closed. In the vicinity of the signature divider 10 the drivable belt systems 11, 12 are guided by guide rollers 45, 46, 51. A belt reversing device 52 located underneath the divider tongue 40 has reversing rollers, which are respectively alternatingly located behind each other in the axial direction, for the belts of the secondary drivable belt systems 11*a*, 12*a* as may be seen in FIGS. 2 and 3.

The first and the second cutting cylinder pairs 4, 6 are connected with each other by means of a gear which is not specifically shown, so that the second cutting cylinder pair 6 is given a circumferential speed which, for example, is higher by 4%. The gear is connected with a motor M1.

Both the cross-folding device 26 of the product flow path A and the cross-folding device 27 of the product flow path B are each connected with a motor M2, M3, respectively. The motors M2, M3 are designed as three-phase current motors and are respectively connected via an electric line with one power element 56 of a, for example digital, drive regulator 57, 58, 59 as shown most clearly in FIG. 4.

One control element 61 of each drive regulator 57, 58, 59 is connected via lines with an actual value transmitter 62, 63, 64, for example an angle encoder, of a rotating element 4, 31, 32 driven by the respective one of the motor-gear units M1, M2, M3.

Further than that, the control element 61 of the drive regulator 57, 58, 59 respectively has an input for a line coming from a central unit 66. This central unit 66 provides a central actual value signal for all individual drives of the printing press.

Figure 4:
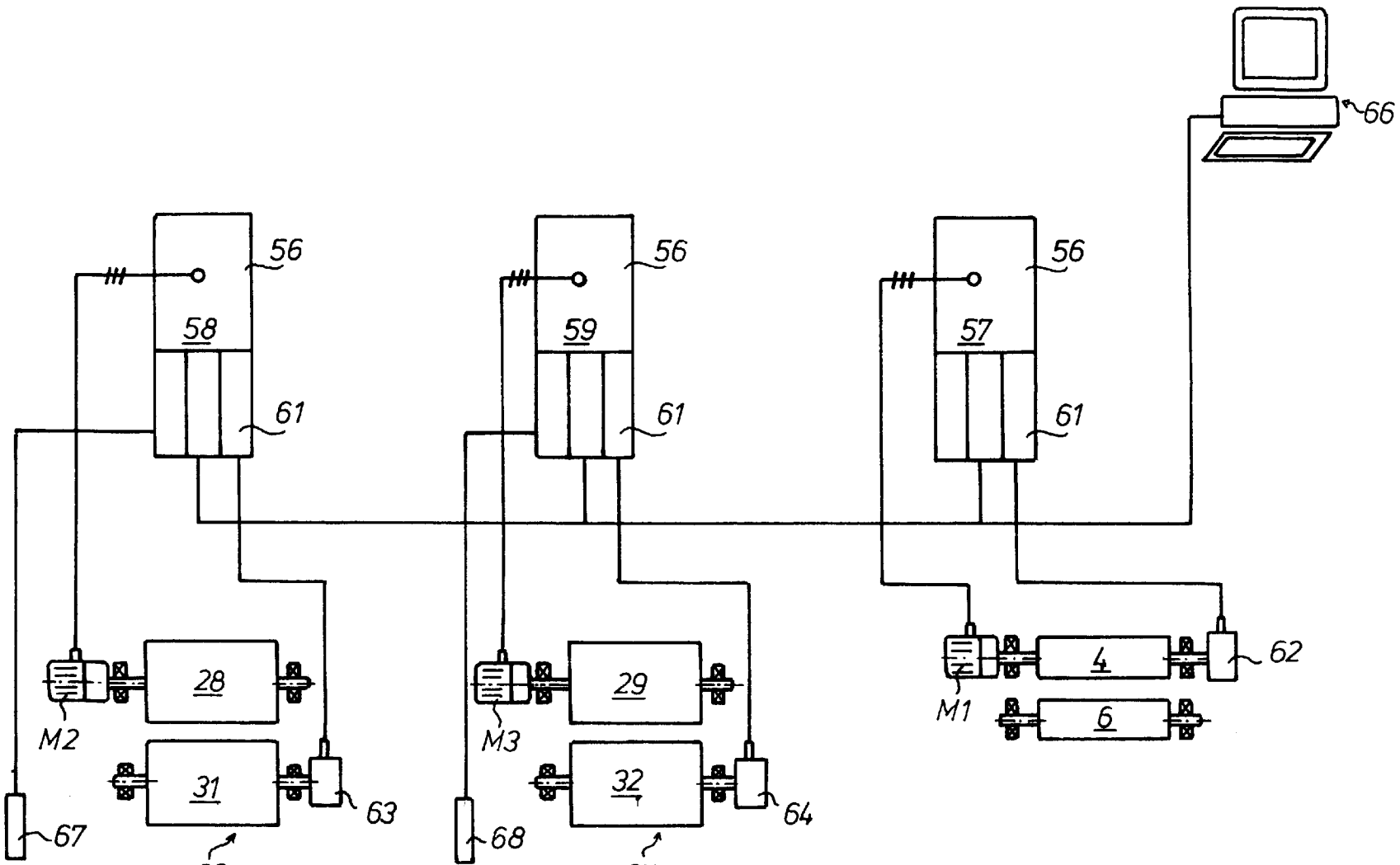
FIG. 4, a schematic representation of a register-maintaining position regulation of cylinder elements of a folding apparatus.

A sensor 67, 68 is arranged in the running direction of the signatures 41 to 44, or respectively 47 to 50, a short distance ahead of the cross-folding device 26, 27 in each product flow path A, B. The sensor 67, 68 is also connected via a line with the control element 61 of the drive regulator 58, 59, again as seen in FIG. 4.

Figure 1:
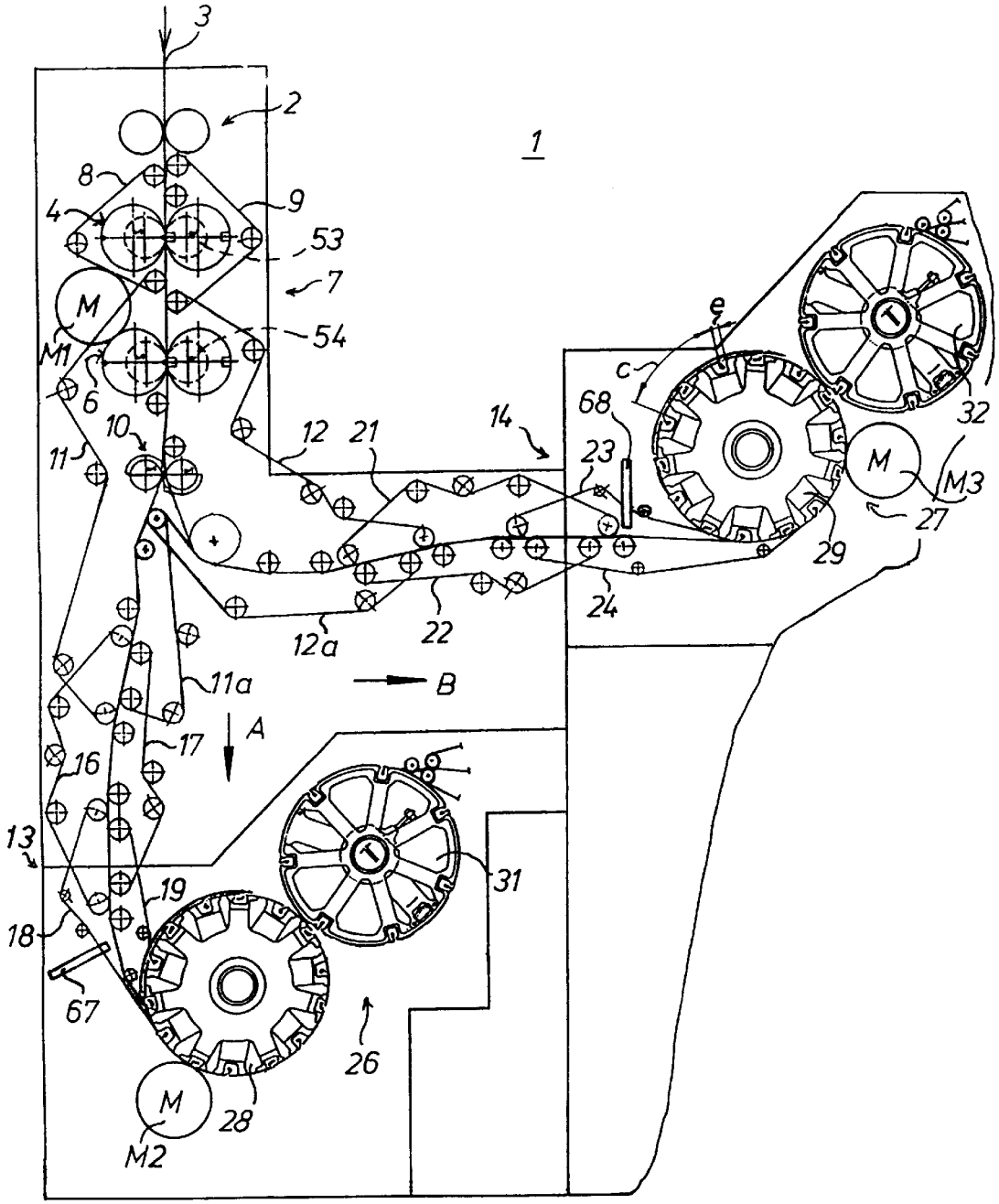
FIG. 1, a detail of a lateral view of the folding apparatus in accordance with the invention.

The folding apparatus in accordance with the present invention as described hereinbelow. The incoming product train 3 as seen in FIG. 1 is transversely perforated by the first cutting cylinder pair 4, wherein the cutting cylinder circumference is matched to a respective cutting length c as seen in FIG. 2, for example 490 mm, of the signatures 41 to 44 to be cut. The cutting length c is, for example, a normal cutting length. It corresponds to a distance between the adjoining gripper systems arranged on the circumference of the gripper and folding blade cylinder 28, 29. A circumferential speed of the first cutting cylinder pair 4 here corresponds to the speed of the incoming product train 3. The second cutting cylinder pair 6 is designed the same as the first cutting cylinder pair 4 and runs slightly faster than the first cutting cylinder pair 4 and slightly slower than the drivable belt system 11, 12, or respectively the secondary drivable belt system 11*a*, 12*a*. Because of this, a spacing distance e, for example of 20 mm, is created between the signatures 41, 42, 43 entering the signature divider 10 in the acceleration section formed by the belt system 11, 11*a*, 12, 12*a*. The distance e is required for the correct assignment of the signatures 41 to 44 to the product flow paths A, B by means of the curved sections 36, 37 of the cylinder-shaped divider members 33, 34. Therefore a signature 43, or respectively 44, has entered into each product flow path A, or respectively B, whose rear edge has a distance of c+2*e* from the respectively following signatures 41, or respectively 42. Only every other signature 43, 41, or 44, 42, respectively reaches a cross-folding device 26 or 27. This means that the cross-folding devices 26, 27 can operate at approximately one-half the speed of the product train 3 entering the draw-in roller group 2, i.e. at half the clock speed. The first stage deceleration belt system 16, 17, or respectively 21, 22 of the deceleration section 13, or 14, which respectively follows the signature divider 10, runs at a speed which is reduced in comparison with the signature divider 10 to such an extent, that approximately half the kinetic energy of the signatures 41 to 44 can be reduced, wherein the inlet speed is reduced to approximately 80%. The respectively following second deceleration belt systems 18, 19, or respectively 21, 22, of the deceleration section 13, or respectively 14, again run at a slower speed in comparison with the upstream connected first belt systems 16, 17, or respectively 21, 22, approximately at 50% of the inlet speed, and transfer the signatures 43, 41, or respectively 44, 42, to the cross-folding device 26, or respectively 27, rotating at the same circumferential speed. In this way, each signature 43, 41, or respectively 44, 42 is decelerated by means of the deceleration section 13, or respectively 14, to such an extent that the signatures 41 to 44 each are at a distance e from each other and can therefore be grasped by the grippers. The distance e at the same time corresponds to the length of a gripper device arranged on the circumference of the gripper and folding blade cylinder 28, or respectively 29. The drivable belt systems 11, 11*a*, 12, 12*a* of the transverse cutting device 7, as well as the first deceleration belt systems 16, 17, or respectively 21, 22, of the deceleration section 13, 14 are each driven separately and rpm-adjustably. Because of the speed during cross-folding being, reduced to approximately one-half in comparison with the inlet speed of the product train 3, damage to the folded products in the cross-folding device 26, 27 is prevented.

It is known from EP 0 257 390 B1 to produce folded products of different lengths in a cross-folding device 26, 27, wherein the distance between the cutting strips of the cutting cylinder pairs 4, 6 can be matched to the respective different lengths of the folded products.

Figure 3:
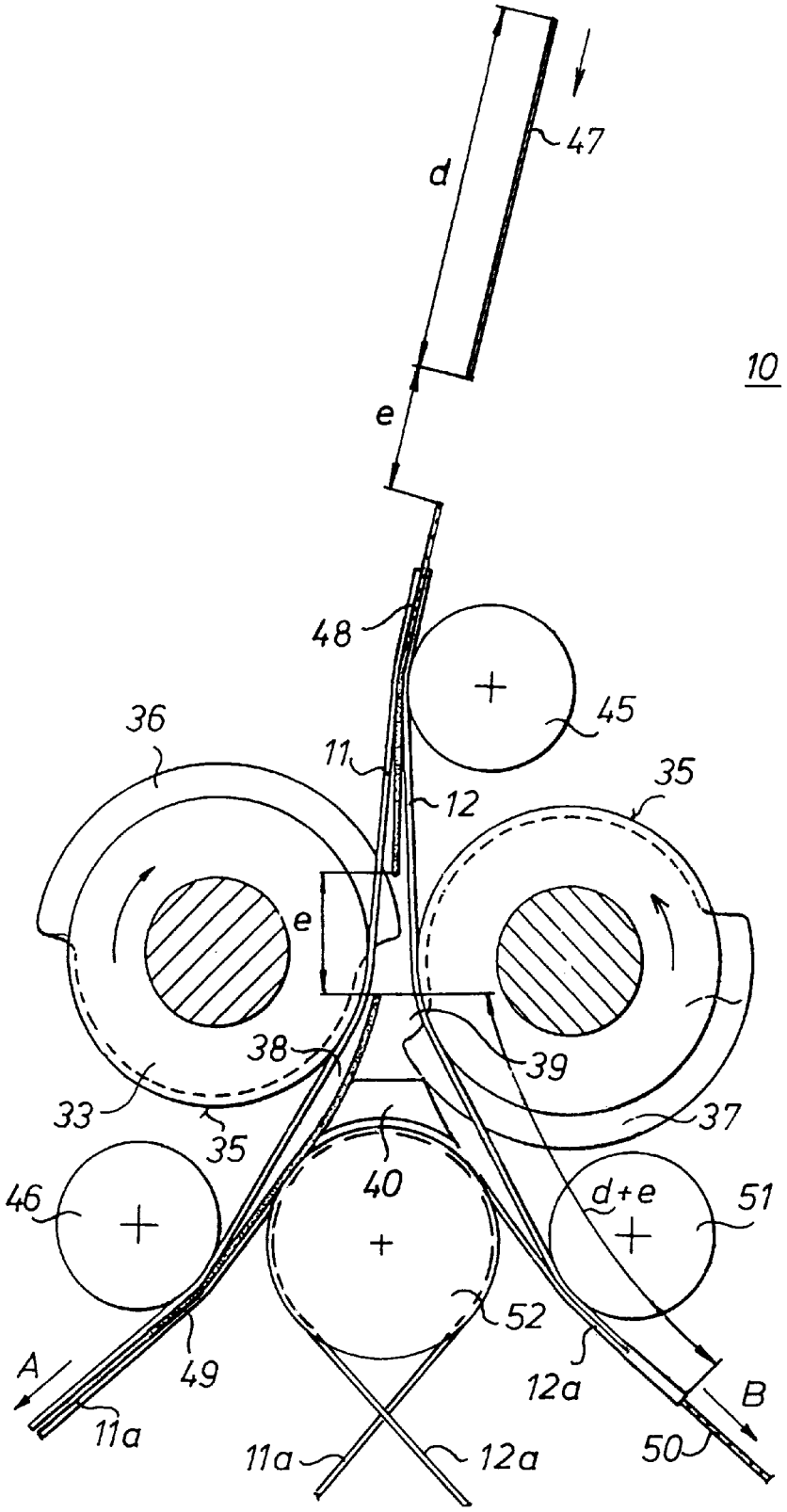
FIG. 3, a representation analogous to FIG. 2, but with a different signature length.

In accordance with a possible production variant, during cross-folding, signatures 47 to 50 of a shorter length d, as seen in FIG. 3, are cut by means of cutting cylinder pairs 53, 54 of a reduced diameter, or respectively reduced cutter distance, as shown in dashed lines in FIG. 1, and are supplied to the signature divider 10 with a distance e, as already described in connection with the first preferred embodiment. The shorter length d of the signatures 47 to 50 can be reduced to 0.6 times, for example, in comparison with the maximal length c of the signatures 41 to 44 shown in FIG. 2. Accordingly, the distance between the signatures 47 to 50 respectively at the start of each product flow path A or B corresponds to that of a missing cutting length d plus the acceleration distance e as seen in FIG. 3. These signatures 47 to 50 entering into the product flow path A, or respectively B, are decelerated in the deceleration section 13, or respectively 14, to the constant gripper distance d plus the gripper length e at the circumference of the gripper and folding blade cylinder 28, or respectively 29, in such a way that the signature is grasped at its respective front end by a gripper strip or a gripper system. In order to always assure the correct position of the front edge of one of the signatures 47 to 50 in the gripper system of the cross-folding device 27—this applies in the same way to one of the signatures 41 to 47 in the gripper system of the cross-folding device 26—, the set value signal transmitted by the central unit 66 is compared with the actual value signal transmitted by the actual value transmitter 63, 64 of the cross-folding device 26, 27. In the process, a signal transmitted by the sensor 67, 68 at the passage of the front edge of the signature is superimposed. If this signal evaluation results in a synchronicity, a zero correction signal is generated. But if there is no synchronicity, a positive or negative correction signal is generated. This signal triggers a brief increase or reduction of the motor speed via the power element 56 of the drive regulator 58, 59. This takes place until the correct position of the front edge of the signatures in the gripper system has been established. The distance between the different signatures 49, 47, or respectively 50, 58, which rest on the gripper cylinder 28, or respectively 29, now is c−d+e. At a circumferential speed of the gripper cylinder 28, or respectively 29, which is to be reduced to approximately 50% in comparison with the speed of the incoming product train 3, and with a reduced cutting length d of the signatures 47 to 50, as well as a constant gripper distance c, the required deceleration by means of the deceleration section 13, or respectively 14, is less and is only approximately 15%. In this way, only every second longitudinally folded product leaving the cross-folding device 26, 27 is cross-folded in each one of the two product flow paths A, B, so that every cross-folding device 26, 27 need only work at half the frequency.

In case of a difference between the set value signal transmitted by the central unit 66 and an actual value transmitted by the actual value transmitter 62 of the cutting cylinder pairs 4, 6 connected by gears, a brief correction of the motor speed is caused by the power element 56 of the drive regulator 57.

The gripper and folding blade cylinders 28, 29, as well as the folding jaw cylinders 31, 32 of the cross-folding devices 26, 27 respectively have device supports which can be adjusted in respect to each other, so that the signatures 41 to 44 and 47 to 50 can be variably cross-folded in accordance with their cutting length c to d. Such a cross-folding device 26, or respectively 27, is known from the previously mentioned EP 0 257 390 B1. All rotatable elements, such as cylinders, rollers of the belt system and the like are rotatably seated in lateral frames, which are known per se. In place of the grippers arranged on the gripper and folding blade cylinders, points can also be arranged in an equivalent manner.

While preferred embodiments of a folding apparatus with a signature divider in accordance with the present invention have been set forth fully and completely hereinabove, it will be apparent to one of skill in the art that a number of changes in, for example the type of printing press being used, the type of printing being done, the type of folded product removal device and the like could be made without departing from the true spirit and scope of the present invention which is accordingly to be limited only by the following claims.

What is claimed is:

1. A folding apparatus for a rotary printing press comprising:

a transverse cutting device for forming a plurality of signatures from a product train;

at least one folding device for folding signatures delivered to said at least one folding device from said transverse cutting device;

a signature divider positioned before, in a direction of signature travel, said at least one folding device, and after, in said direction of signature travel, said transverse cutting device;

two signature paths, a first of said signature paths extending between said signature divider and said at least one folding device, said signature divider dividing signatures between said two signature paths, each of said signature paths being a deceleration section useable to decelerate a rate of travel of said signatures in each of said signature paths; and means to control the speed of deceleration of each of said two signatures paths and to drive each of said deceleration sections at a variable speed with respect to a speed of said transverse cutting device.

2. The folding apparatus of claim 1 wherein said speeds of deceleration of said two signature paths can be controlled together.

3. The folding apparatus of claim 1 wherein said speeds of deceleration of said two signature paths can be individually controlled.

4. The folding apparatus of claim 1 wherein said deceleration section in each of said two signature paths is a multi-stage deceleration section.

5. The folding apparatus of claim 1 wherein said deceleration section in each of said two signature paths is a single-stage deceleration section.

6. The folding apparatus of claim 1 wherein each said deceleration section includes a plurality of belt systems, each of said belt systems being drivable at variable speeds.

7. The folding apparatus of claim 1 wherein said transverse cutting device includes at least one cutting cylinder pair having variable cutting distances to form variable section length signatures.

8. The folding apparatus of claim 1 further including a signature acceleration section upstream in the direction of signatures travel of said signature divider.

9. The folding apparatus of claim 8 wherein said signature acceleration section includes a drivable belt system.

10. The folding apparatus of claim 1 including a signature edge detecting device intermediate said signature divider and said folding device and on each of said two signature paths and further including a motor and a motor regulator for driving said folding device and further including an angle encoder on a rotating element of said motor for said folding device, said angle encoder sensing angular positions of said motor for said folding device, and means for regulating said motor in response to said sensed angular positions and a location of a signature detected by said signature edge detecting device.

11. The folding apparatus of claim 7 including a transverse cutting device drive motor having a connection to a power element of a drive regulator having a control element, and further including an actual value transmitter for said transverse cutting device and a control unit that can transmit a set value, said control element of said drive regulator being connected with said actual value transmitter and with said control unit.

* * * * *